US006312270B1

(12) United States Patent
Hamon

(10) Patent No.: US 6,312,270 B1
(45) Date of Patent: Nov. 6, 2001

(54) FLAT PANEL DISPLAY DEVICE

(75) Inventor: Olivier Hamon, Crolles (FR)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/393,069

(22) Filed: Sep. 7, 1999

(30) Foreign Application Priority Data

Sep. 21, 1998 (EP) ..... 98402341

(51) Int. Cl.[7] ..... H01R 13/44
(52) U.S. Cl. ..... 439/131
(58) Field of Search ..... 439/131, 501, 439/946, 76.1, 630, 57, 140, 535; 361/681; 348/827

(56) References Cited

U.S. PATENT DOCUMENTS 5,637,018 6/1997 Gargiulo ..... 439/640
5,692,914 * 12/1997 Mitani et al. ..... 439/131
5,751,544 * 5/1998 Song ..... 361/681
5,934,917 * 8/1999 Haut ..... 439/131
6,061,104 * 5/2000 Evanicky et al. ..... 348/827

FOREIGN PATENT DOCUMENTS 0251515 1/1988 (EP) .

* cited by examiner

*Primary Examiner*—Neil Abrams
*Assistant Examiner*—J. F. Duverne

(57) ABSTRACT

A flat panel display device comprising a display member having a display surface, the display member being provided with one or more cable connectors for connecting cables to the device, characterised in that the connectors are mounted on the display member via a hinge so as to be movable relative to the display member from a first position in which cables can be easily mated with the connectors and a second position.

4 Claims, 4 Drawing Sheets

FLAT PANEL DISPLAY DEVICE

FIELD OF THE INVENTION

The present invention relates to flat panel display monitors.

BACKGROUND OF THE INVENTION

With improvements in display technology, flat panel display devices for computers have become more commonplace in office environments and are finding greater application to televisions and video monitors.

Typically, such devices have used cabinets and housings which are generally similar to those used for CRT monitors, although of course with a much shallower profile.

In particular, such cabinets have comprised fixed connectors for connecting any necessary cables (eg power cables, video input and possibly touch screen cables) to the device. Whilst fixed connectors are generally satisfactory for CRT displays, their use with flat panel displays can exhibit certain inconveniences or can detract from the space advantages associated with the use of a flat panel.

Known flat panel devices have generally used one of two arrangements for the connectors. In a first arrangement the connectors lie in a plane parallel to the display screen, usually facing downwards so that cables have to be urged in a upwards direction to engage the connectors. Alternatively, connectors have been arranged to the rear of the display device facing backwards so that cables have to be urged in a direction perpendicular to the display surface to be engaged.

With the former arrangement with the connectors facing downwards it can be very awkward to connect cables to the monitor because of reduced clearance between a horizontal surface on which the monitor may be standing. Generally, the user is obliged to lay down the cabinet to connect the cables. This means that the flat panel front surface comes into contact with the desktop surface. For LCD flat panels, it has been found that this action can generate scratches and other damage to the polarizer layer of the LCD panel. With the latter arrangement the cables and their plugs take up space and can be inconvenient in some applications, for instance if the device is to be wall mounted.

This invention is intended to overcome the drawbacks of the prior art and provide an improved cabling arrangement for flat panel displays.

SUMMARY OF THE INVENTION

In brief, this is achieved by a flat panel display device comprising a display member having a display surface, the display member being provided with one or more cable connectors for connecting cables to the device, characterised in that the connectors are mounted on the display member via a hinge so as to be movable relative to the display member from a first position in which cables can be easily mated with the connectors and a second position.

In a preferred embodiment, in the first position cables can be connected to the connectors by urging in a direction at least partially perpendicular to the display surface and in the second position cables connected to the connectors lie at least partially parallel to the display surface.

The connectors can therefore be flipped up in order to connect cables and flipped down again so as not to obstruct normal operation of the device.

Generally the connectors would be mounted on a rear face of the device, although a similar approach could be used for connectors mounted on the front of the device should this be necessary.

It is expected that the advantages of the invention will be greatest for flat panel computer monitors, although application of the invention to other flat panel display devices such as flat screen televisions is not excluded.

BRIEF DESCRIPTION OF THE DRAWINGS

A flat panel display device embodying the invention will now be described, by way of non-limiting example, with reference to the accompanying diagrammatic drawings, in which.

BEST MODE OF CARRYING OUT THE INVENTION

Figure 1:
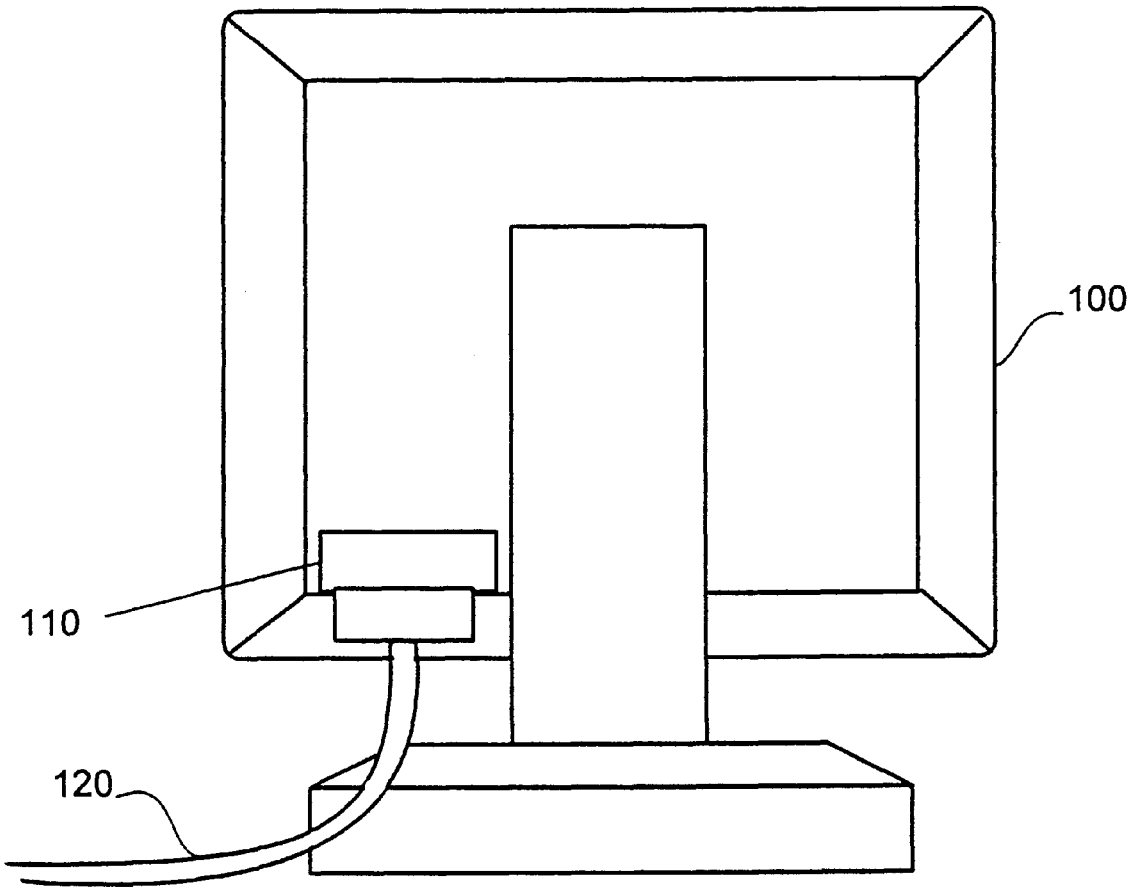
FIG. 1 is a rear view of the flat panel display device.

Referring to FIG. 1, there is shown a rear view of a flat panel display device 100. The device comprises cable connector plate 110 for connecting cable 120 to the device. For clarity in this example, only one cable is shown connected to the device, although it will be appreciated that typically such a display device could require two or perhaps three cables to be connected.

Figure 2:
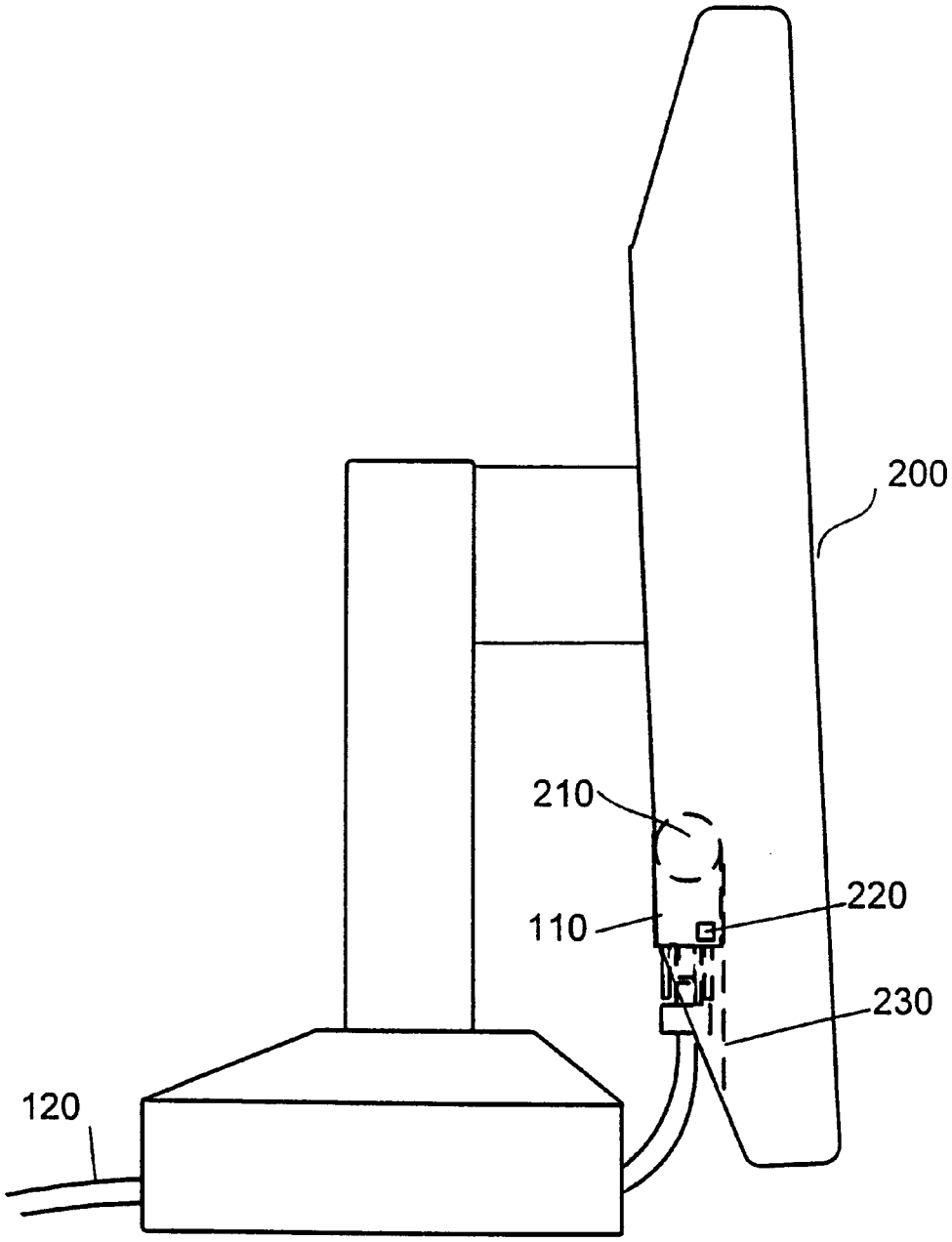
FIG. 2 is a left side view of the flat panel display device with a cable connected.
Figure 3:
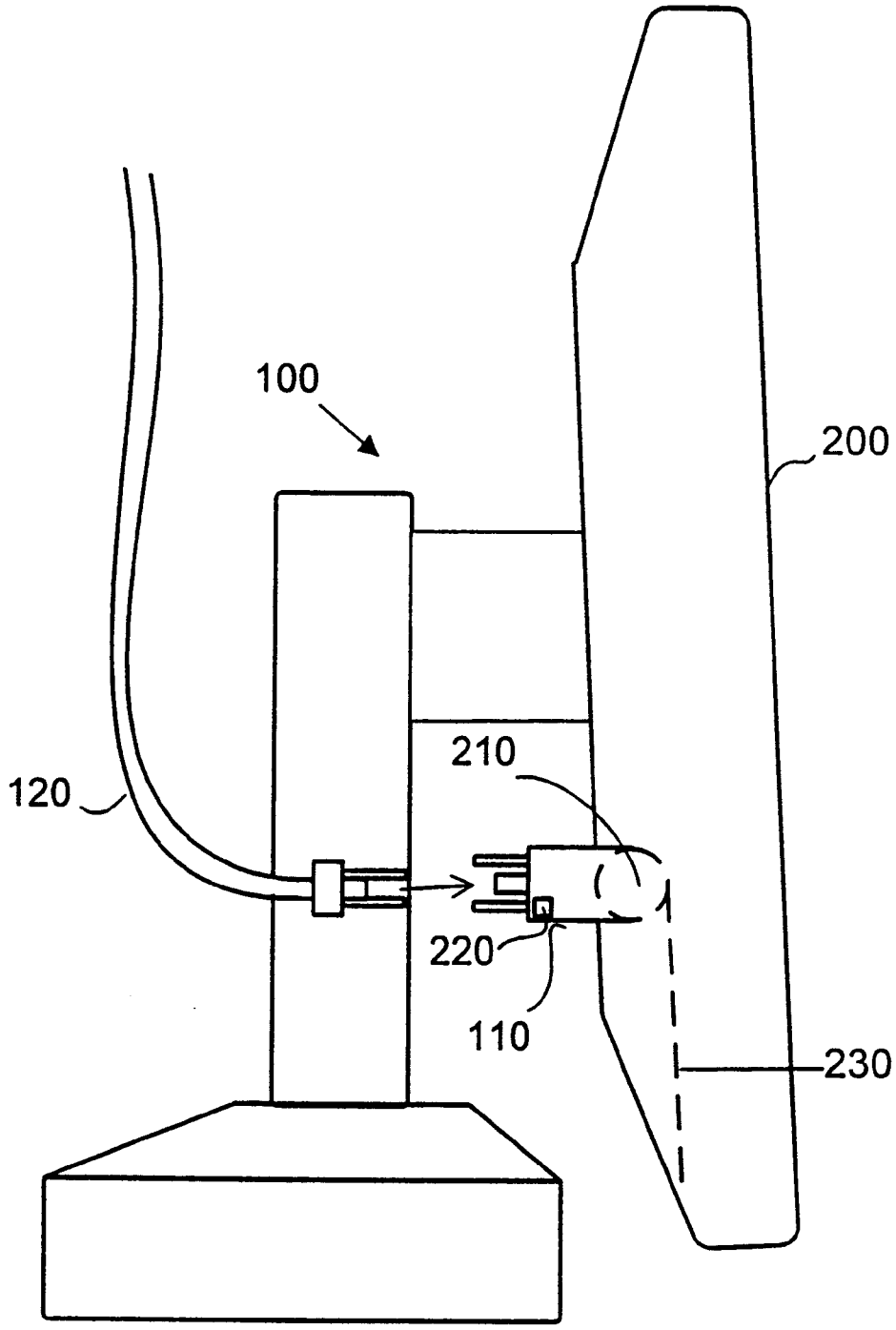
FIG. 3 is a left side view of the flat panel display device showing a cable being connected.

As can be seen more clearly in FIGS. 2 and 3, connector plate 110 is mounted on a hinge 210 and is movable from the position shown in FIG. 3 in which cable 120 can be connected by urging in a direction perpendicular to the display screen 200 and the shown in FIG. 2 in which cable 120 connected to the connector plate 110 lies parallel to the display screen 200.

Figure 4:
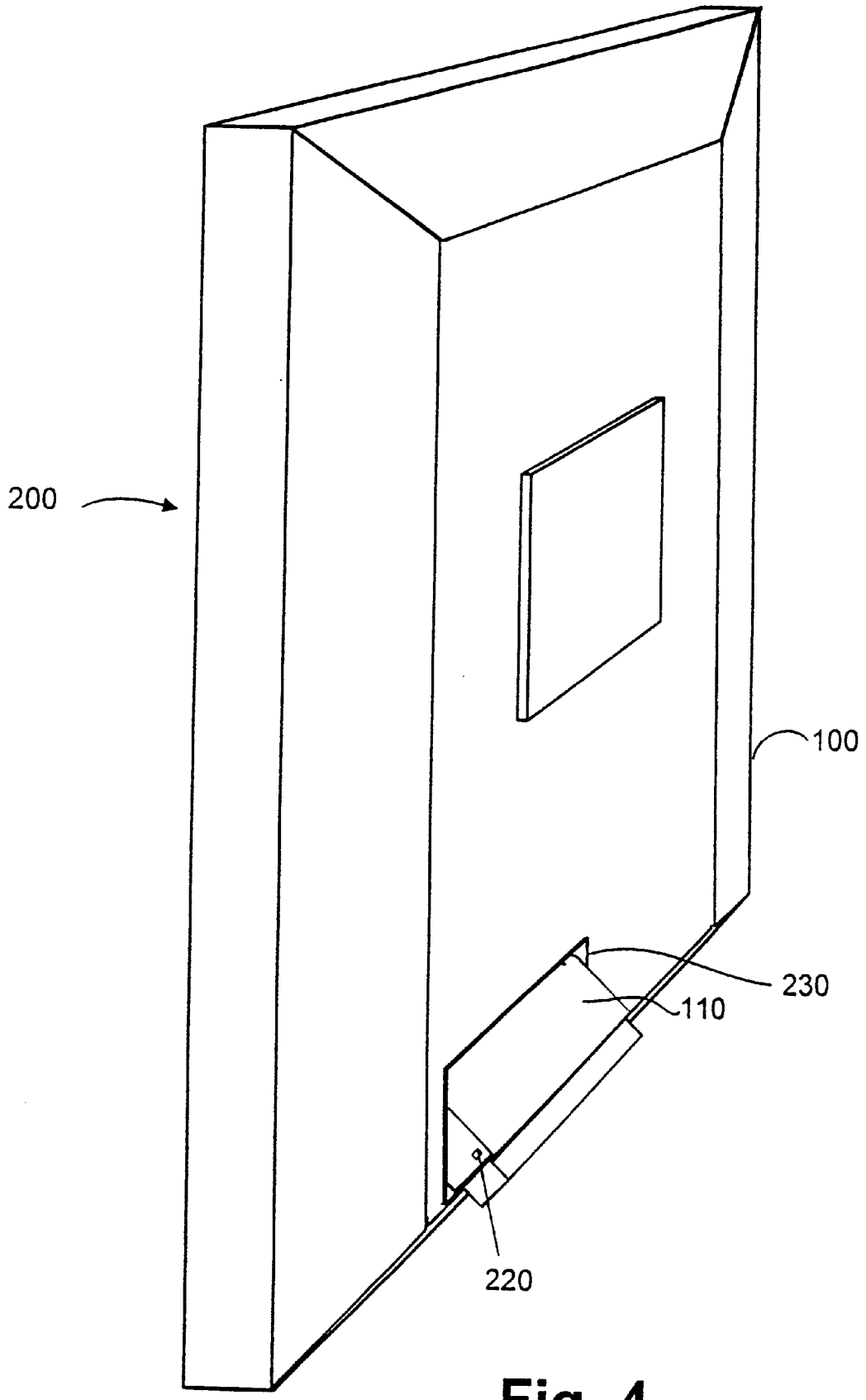
FIG. 4 is a perspective view of the flat panel display device.

FIG. 4 is a perspective view of the main body of the display showing connector plate 110 in a partially open position.

In this illustrative embodiment, cable connector plate 110 has bosses 220 on each side so as to make an interference fit into recess 230. It will be appreciated that many other clip arrangements would be possible. It would equally be possible for connector plate 110 to be floating so that it finds its own optimal angular position in any given configuration.

In order to connect a cable to connector plate 110, a user simply has to flip up connector plate 110, connect the cable by urging it in a direction generally perpendicular to the display. Once the cables are connected, connector plate 110 can be flipped down so that the cables lie flush with the rear face of the device as shown in FIG. 2.

Although a specific embodiment of the invention has been described, the invention is not to be limited to the specific arrangement so described. The invention is limited only by the claims.

What is claimed is:

1. A flat panel display device comprising a display member having a display surface, the display member being provided with one or more cable connectors for connecting cables to the device, wherein said cable connectors are mounted on a hinge on the display member so as to be movable relative to the display member from a first position in which cables can be easily mated with the cable connectors and a second position.

2. A flat panel display as claimed in claim 1 wherein in the first position cables can be connected to said cable connectors by urging in a direction at least partially perpendicular to the display surface.

3. A flat panel display device as claimed in claim 2 wherein in the second position cables connected to said cable connectors lie at least partially parallel to the display surface.

4. A flat panel display device as claimed in claim 1 wherein said cable connectors are mounted on a rear face of the device.

* * * * *